US009440338B2

(12) United States Patent
Crawford

(10) Patent No.: US 9,440,338 B2
(45) Date of Patent: Sep. 13, 2016

(54) WRENCH EXTENSION DEVICE

(71) Applicant: Chappel W. Crawford, Michigan City, IN (US)

(72) Inventor: Chappel W. Crawford, Michigan City, IN (US)

( * ) Notice: Subject to any disclaimer, the term of this patent is extended or adjusted under 35 U.S.C. 154(b) by 204 days.

(21) Appl. No.: 14/207,980

(22) Filed: Mar. 13, 2014

(65) Prior Publication Data

US 2015/0258668 A1 Sep. 17, 2015

(51) Int. Cl.

| | |
|---|---|
| ***B25B 17/00*** | (2006.01) |
| ***B25B 13/48*** | (2006.01) |
| ***B25B 23/00*** | (2006.01) |

(52) U.S. Cl.

CPC ..... *B25B 17/00* (2013.01); *B25B 13/481* (2013.01); *B25B 23/0021* (2013.01)

(58) Field of Classification Search

CPC .. B25B 17/00; B25B 23/0021; B25B 13/481
USPC ..... 81/57.3, 56, 57
See application file for complete search history.

(56) References Cited

U.S. PATENT DOCUMENTS

| | | | | |
|---|---|---|---|---|
| 3,714,852 | A | 6/1971 | Giangrasso | |
| 3,754,486 | A | 8/1973 | Mariner | |
| 4,279,314 | A | 7/1981 | Taub | |
| 4,867,016 | A | 9/1989 | Di Edwardo | |
| 5,540,122 | A * | 7/1996 | Lund | B25B 13/481 81/57.14 |
| 5,732,605 | A | 3/1998 | Mann | |
| 6,832,531 | B1 * | 12/2004 | Marquardt | B23Q 5/045 81/57.3 |
| 7,047,844 | B1 | 5/2006 | Macor | |
| 7,182,000 | B1 | 2/2007 | Dicksen | |
| D551,042 | S | 9/2007 | Tuan Mu | |
| 7,344,462 | B1 * | 3/2008 | Lund | F16H 7/18 474/155 |
| 2007/0022846 | A1 * | 2/2007 | Fryatt | B25B 17/00 81/57.3 |
| 2007/0044600 | A1 | 3/2007 | Chen | |
| 2009/0084230 | A1 * | 4/2009 | Selgas | B25B 13/467 81/467 |
| 2009/0301270 | A1 | 12/2009 | Hart | |
| 2011/0000342 | A1 * | 1/2011 | Lambert | B25B 15/001 81/57 |

* cited by examiner

*Primary Examiner* — Hadi Shaker
*Assistant Examiner* — Danny Hong

(57) ABSTRACT

A wrench extension device laterally offsets connection between a socket and a driving tool to facilitate rotation of the socket in tight spaces. The device includes an elongated housing and a first gear rotatably coupled to the housing proximate a first end of the housing. A socket drive is coupled to the first gear for coupling to a socket rotated by the first gear. A second gear is rotatably coupled to the housing proximate a second end of the housing. A receiver extends into the second gear for being engaged by a driving tool wherein the second gear is rotatable by the driving tool. A chain is positioned in the housing engaging the first gear and the second gear wherein rotation of the second gear rotates the first gear.

5 Claims, 3 Drawing Sheets

WRENCH EXTENSION DEVICE

BACKGROUND OF THE DISCLOSURE

Field of the Disclosure

The disclosure relates to tool extension devices and more particularly pertains to a new tool extension device for laterally offsetting connection between a socket and a driving tool to facilitate rotation of the socket in tight spaces.

SUMMARY OF THE DISCLOSURE

An embodiment of the disclosure meets the needs presented above by generally comprising an elongated housing and a first gear rotatably coupled to the housing proximate a first end of the housing. A socket drive is coupled to the first gear for coupling to a socket rotated by the first gear. A second gear is rotatably coupled to the housing proximate a second end of the housing. A receiver extends into the second gear for being engaged by a driving tool wherein the second gear is rotatable by the driving tool. A chain is positioned in the housing engaging the first gear and the second gear wherein rotation of the second gear rotates the first gear.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
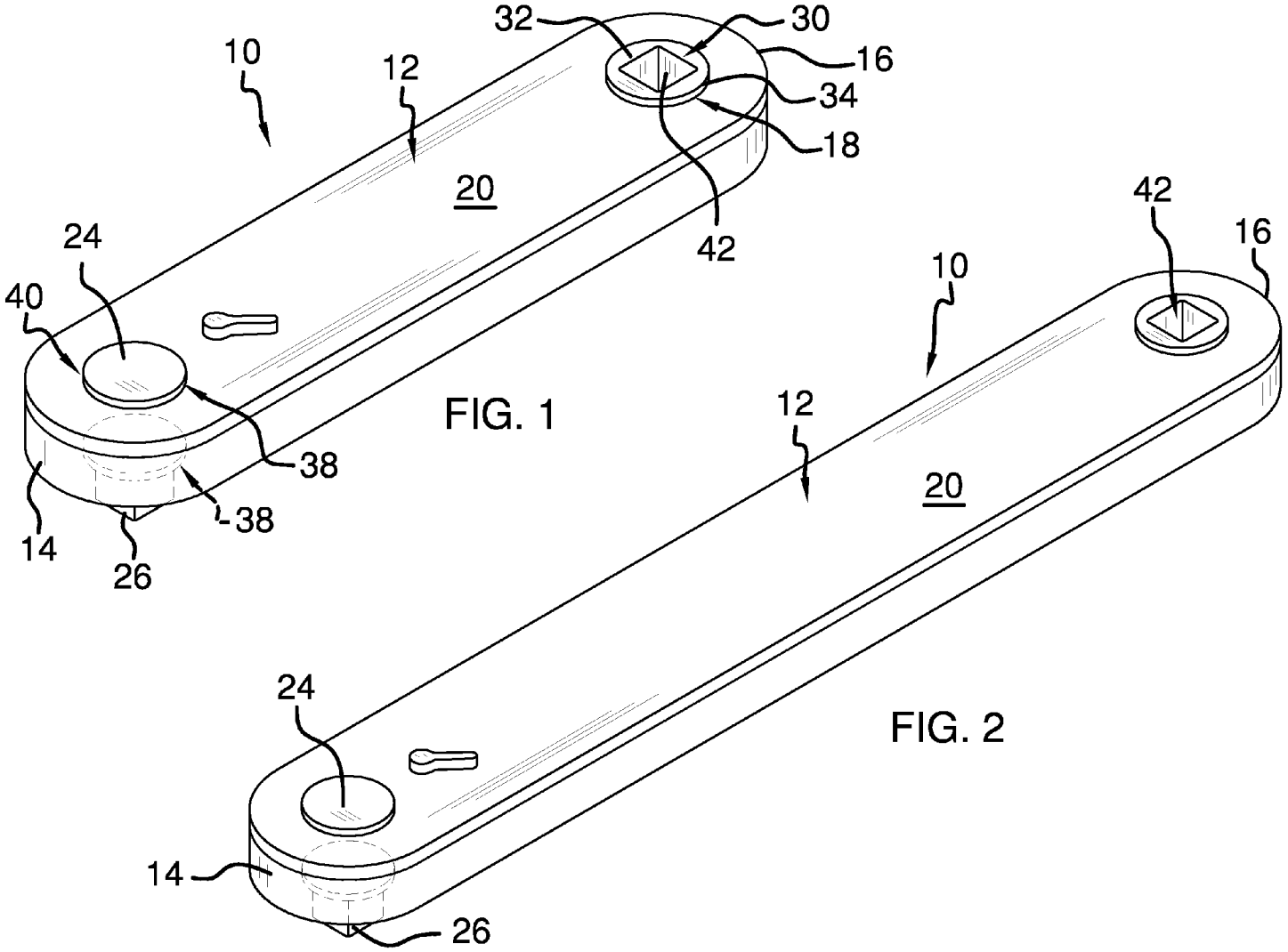
FIG. 1 is a top front side perspective view of a wrench extension device according to an embodiment of the disclosure.
FIG. 2 is a top front side perspective view of a longer embodiment of the disclosure.
Figure 3:
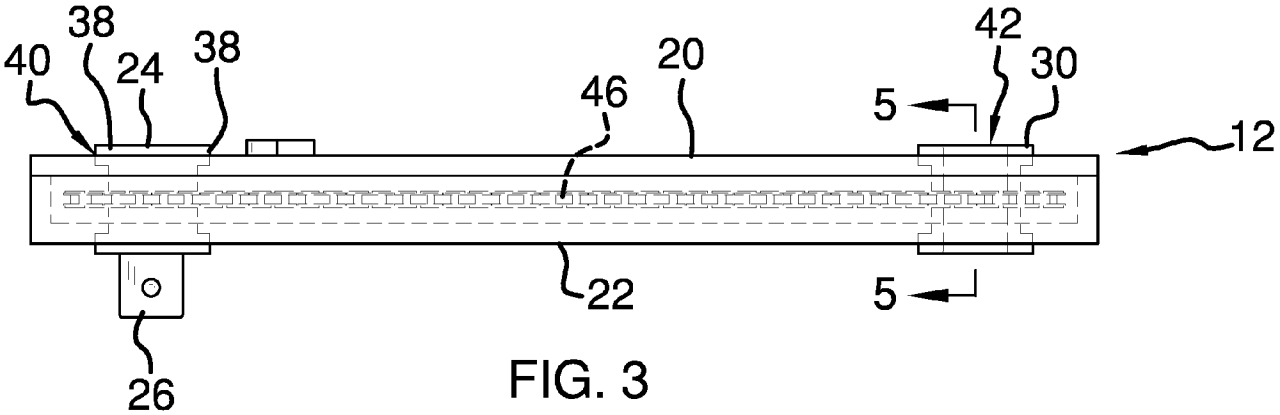
FIG. 3 is a side view of an embodiment of the disclosure.
Figure 4:
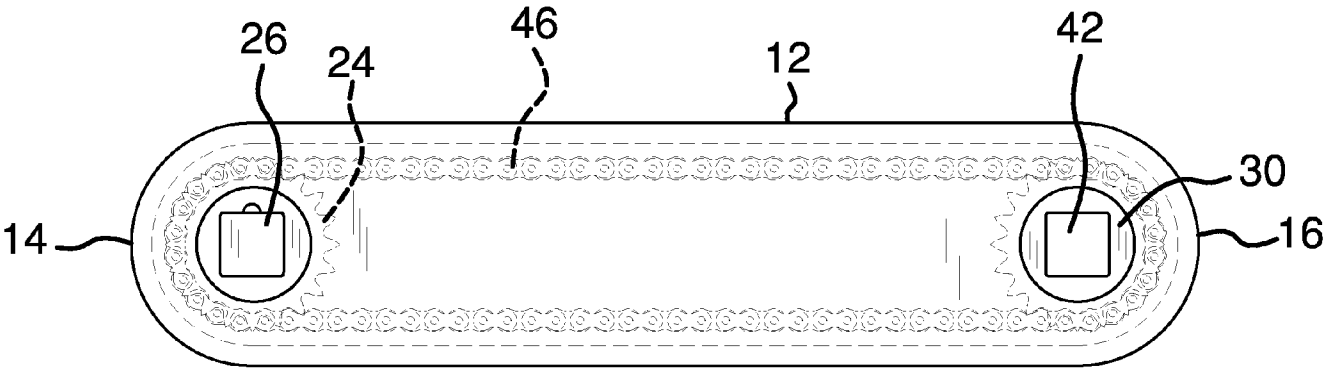
FIG. 4 is a bottom view of an embodiment of the disclosure.
Figure 6:
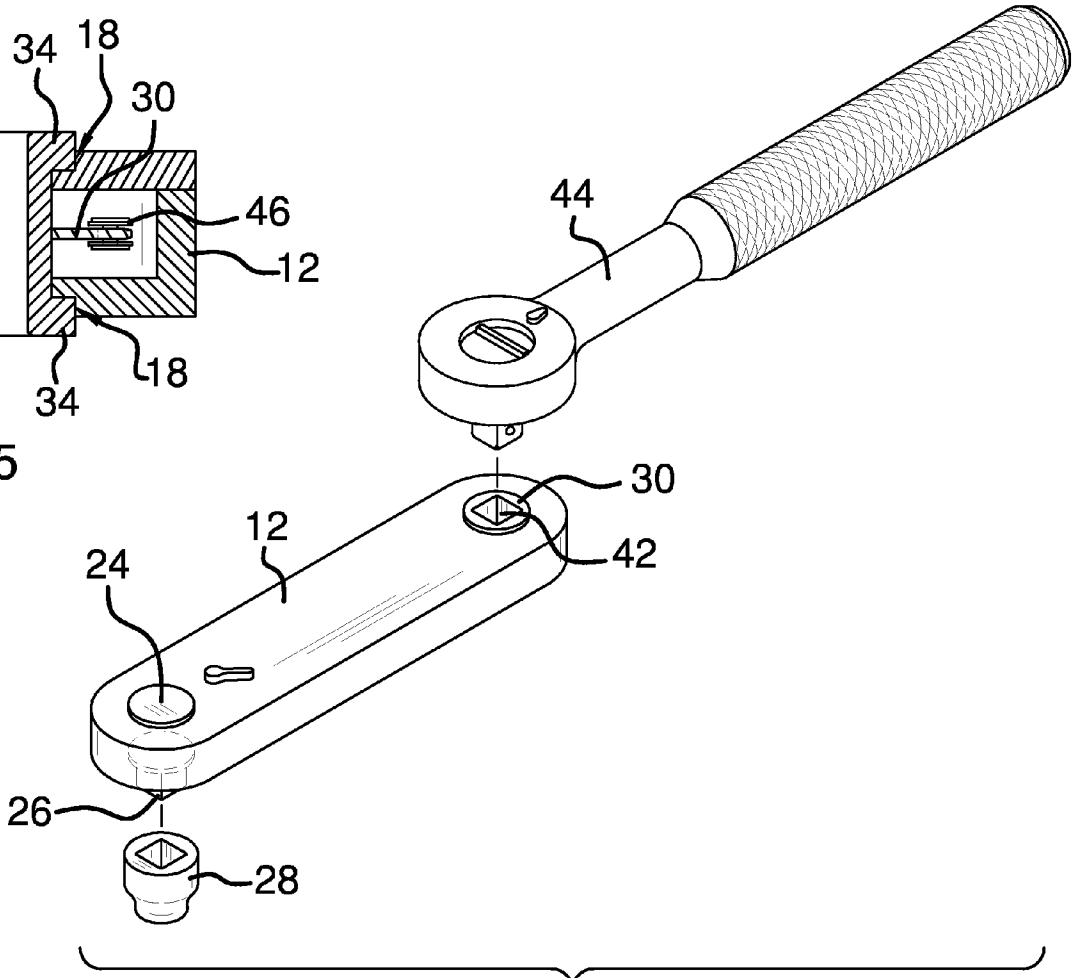
FIG. 6 is a partially exploded view of an embodiment of the disclosure in use.

With reference now to the drawings, and in particular to FIGS. 1 through 6 thereof, a new tool extension device embodying the principles and concepts of an embodiment of the disclosure and generally designated by the reference numeral 10 will be described.

Figure 5:
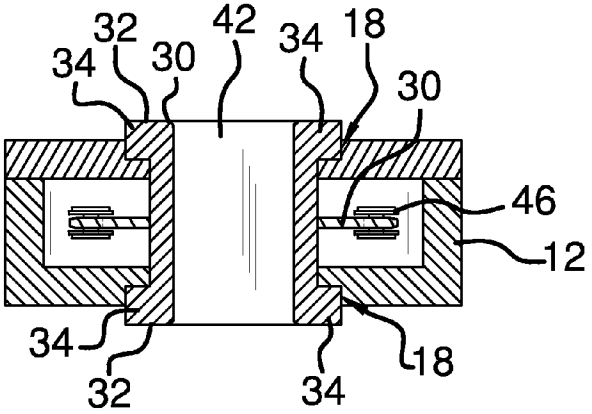
FIG. 5 is a cross-sectional view of an embodiment of the disclosure taken along line 5-5 of FIG. 4.

As best illustrated in FIGS. 1 through 6, the wrench extension device 10 generally comprises a housing 12 having a first end 14 and a second end 16. The housing 12 is elongated between the first end 14 and the second end 16. The housing 12 further comprises a pair of wells 18 as shown in FIG. 5. Each well 18 extends into a respective one of an upper face 20 and a bottom face 22 of the housing 12. The wells 18 are aligned. A first gear 24 is rotatably coupled to the housing 12 proximate the first end 14 of the housing 12. A socket drive 26 is coupled to the first gear 24 wherein the first gear 24 is configured for coupling to a selectable socket 28 wherein the socket 28 is rotated by the rotation of the first gear 24. A second gear 30 is also rotatably coupled to the housing 12 but positioned proximate the second end 16 of the housing 12. The second gear 30 extends fully through the housing 12 wherein opposite faces 32 of the second gear 30 are positioned outside of the housing 12. The second gear 30 has a pair of radial flanges 34 extending outwardly from the second gear 30. Each radial flange 34 is positioned adjacent to an associated one of the opposite faces 32 of the second gear 30. Each well 18 receives an associated one of the radial flanges 34 of the second gear 30 wherein the second gear 30 is coupled to the housing 12. The first gear 24 may be similarly provided with flanges 38 seated in wells 40 in the housing 12. A receiver 42 extends into the second gear 30 wherein the second gear 30 is configured for being engaged by a driving tool 44 such as a wrench, ratchet, or the like. The second gear 30 is rotatable by the driving tool 44. The receiver 42 extends fully through the second gear 30 between the opposite faces 32 of the second gear 30 allowing the driving tool 44 to be coupled to the second gear 30 from either side of the housing 12. The receiver 42 has a consistent transverse cross-sectional shape between the opposite faces 32 of the second gear 30. A chain 46 is positioned in the housing 12. The chain 46 engages the first gear 24 and the second gear 30 wherein rotation of the second gear 30 rotates the first gear 24.

In use, the socket 28 is selected and coupled to the socket drive 26 extending from the housing 12. The socket 28 may then be engaged to a fastener or the like which a user wishes to rotate. The drive tool 44 is coupled to the receiver 42 and manipulated to rotate the second gear 30. Rotation of the second gear 30 is transferred to rotate the first gear 24, and the socket 28, by the chain 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A wrench extension device comprising:

a housing having a first end and a second end, said housing being elongated between said first end and said second end;

a first gear rotatably coupled to said housing proximate said first end of said housing;

a socket drive coupled to said first gear wherein said first gear is configured for coupling to a socket wherein the socket is rotated by said rotation of said first gear;

a second gear rotatably coupled to said housing proximate said second end of said housing, said second gear extending fully through said housing such that opposite faces of said second gear are positioned outside of said housing, said second gear having a pair of radial flanges extending outwardly from said second gear perpendicular to an axis of rotation of said second gear, each said radial flange being partially inset into an outer surface of said housing, each radial flange being positioned adjacent to an associated one of said opposite faces of said second gear;

a receiver extending into said second gear wherein said second gear is configured for being engaged by a driving tool wherein said second gear is rotatable by the driving tool; and a chain positioned in said housing, said chain engaging said first gear and said second gear wherein rotation of said second gear rotates said first gear.

2. The device of claim 1, further comprising said receiver extending fully through said second gear between said opposite faces of said second gear.

3. The device of claim 2, further comprising said receiver having a consistent transverse cross-sectional shape between said opposite faces of said second gear.

4. The device of claim 1, further comprising said housing comprising a pair of wells, each said well extending into a respective one of an upper face and a bottom face of said housing, said wells being aligned, each said well receiving an associated one of said radial flanges of said second gear wherein said second gear is coupled to said housing.

5. A wrench extension device comprising:

a housing having a first end and a second end, said housing being elongated between said first end and said second end, said housing comprising a pair of wells, each said well extending into a respective one of an upper face and a bottom face of said housing, said wells being aligned;

a first gear rotatably coupled to said housing proximate said first end of said housing;

a socket drive coupled to said first gear wherein said first gear is configured for coupling to a socket wherein the socket is rotated by said rotation of said first gear;

a second gear rotatably coupled to said housing proximate said second end of said housing, said second gear extending fully through said housing wherein opposite faces of said second gear are positioned outside of said housing, said second gear having a pair of radial flanges extending outwardly from said second gear perpendicular to an axis of rotation of said second gear, each said radial flange being partially inset into an outer surface of said housing, each radial flange being positioned adjacent to an associated one of said opposite faces of said second gear, each said well receiving an associated one of said radial flanges of said second gear wherein said second gear is coupled to said housing;

a receiver extending into said second gear wherein said second gear is configured for being engaged by a driving tool wherein said second gear is rotatable by the driving tool, said receiver extending fully through said second gear between said opposite faces of said second gear, said receiver having a consistent transverse cross-sectional shape between said opposite faces of said second gear; and a chain positioned in said housing, said chain engaging said first gear and said second gear wherein rotation of said second gear rotates said first gear.

* * * * *